US006298885B1

(12) United States Patent
Yoshino et al.

(10) Patent No.: US 6,298,885 B1
(45) Date of Patent: Oct. 9, 2001

(54) POWDER ACCOMMODATING CONTAINER

(75) Inventors: Masahiro Yoshino; Tatsuo Nakanishi; Yasuaki Tsuji, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/504,688

(22) Filed: Feb. 15, 2000

(30) Foreign Application Priority Data

Feb. 16, 1999 (JP) ..... 11-037147

(51) Int. Cl.[7] ..... B65B 3/16

(52) U.S. Cl. ..... 141/114; 141/369; 141/391; 220/9.4; 220/495.01

(58) Field of Search ..... 141/18, 21, 84, 141/114, 313–316, 346, 347, 351, 352, 369, 363–366, 391; 222/92, 94, 105, 107, 153.05, 562; 426/111; 220/9.4, 495.01

(56) References Cited

U.S. PATENT DOCUMENTS 2,952,379 * 9/1960 Potter ..... 220/6
3,921,897 * 11/1975 Noyes et al. ..... 206/218
5,731,021 * 3/1998 Spector ..... 426/111

* cited by examiner

*Primary Examiner*—Timothy L. Maust
(74) *Attorney, Agent, or Firm*—Jordan B. Bierman; Bierman, Muserlian and Lucas

(57) ABSTRACT

A powder accommodating container for accommodating powder includes: a flexible bag having an opening, capable of storing the powder; a protecting member for enclosing at least part of the flexible bag, wherein the protecting member is capable of being transformed; and a cover mounted on the protecting member, for opening and closing the opening.

18 Claims, 7 Drawing Sheets

POWDER ACCOMMODATING CONTAINER

BACKGROUND OF THE INVENTION

The present invention relates to a powder accommodating container to fill and accommodate the powder, and to an improvement of a toner accommodating container which is detachably structured to replenish powdered toner to a developing device of an electrostatic image forming apparatus such as, for example, an electrophotographic copier or laser printer.

Conventionally, as a means to replenish easily scattered powder into a powder receiving device, a power container in which the powder is accommodated and whose powder replenishing opening portion is hermetically sealed by a film-like seal material, is used. When the powder is replenished, after the powder container is turned upside down, and the opening portion is turned to the down side and mounted onto the mounting portion of the powder receiving device, by pealing the seal material, the powder flows from the opening portion and is replenished into a hopper of the receiving device. The powder container as described above is widely used because the powder does not scatter to the outside when the powder is replenished.

In the electrostatic image forming apparatus, an electrostatic latent image on a rotating electric charge carrier is developed by a developing device, and after the powder toner in the toner is adhered onto an electrostatic latent image portion and forms a toner image, the toner image is transferred onto the recording sheet and fixed. Because the powder toner is consumed together with the development, it is necessary to replenish the toner to the developing device corresponding to the consumption, and as a storing portion of the toner to be replenished, a toner hopper is provided.

A large amount of toner is stored in the toner hopper, however, as the toner in the developing device is decreased, the toner in the toner hopper is replenished into the developing device, and the toner in the toner hopper is gradually decreased. Then, when the residual amount of the toner in the toner hopper is decreased, the toner is replenished into the toner hopper from the toner accommodating container (toner replenishing cartridge) in which the toner is accommodated, by an operator.

Although the toner replenishment of the electrostatic recording apparatus using the dry type two-component developer is described above, in also the case of the electrostatic image forming apparatus using one-component developer, the same replenishment is necessary.

In any of the above developers, the toner replenishment is, generally, conducted in such a manner that the toner is replenished from the toner accommodating container to the toner hopper. This toner accommodating container is the above described powder accommodating container.

Generally, as the conventional powder accommodating container, hard containers molded by synthetic resins such as polyethylene resin or PET are used. These powder accommodating containers are hardly breakable even if the content material is consumed and the container is empty, and because the original shape is maintained, the container is bulky and occupies a large space when it is stored as it is.

Further, in order to conduct the scrapping disposal of the empty powder accommodating container, when it is carried to the disposal place, it takes large space in the carrying car for collection, and the withdrawal of large quantity can not be conducted once, and this is inefficient.

Further, the hard powder accommodating container molded by synthetic resins such as polyethylene resin or PET are collected by the manufacturer for protection of environmental pollution or resource recycling, and are shredded and molded again or recycled for other uses, or the accommodating container is washed and filled with the powder and recycled.

An outer wall of the conventional powder accommodating container is strongly formed so that it does not occurs that the container is broken on the way of transportation and the content material leaks to the outside, and for the purpose of the operability when the content material is replenished into the hopper of the receiving device or prevention of scattering. Accordingly, even when the content material is consumed and the container is empty, it is difficult to conduct the destruction processing to collapse the powder accommodating container, and the original shape is maintained.

Further, the storage place for the used powder accommodating container takes up large space. Further, when the used powder accommodating containers are collected and carried, these take up large space in the carrying car, which is inefficient.

SUMMARY OF THE INVENTION

An object of the present invention is to solve the above problems and to provide a powder accommodating container in which, when the unused powder accommodating container is being carried or stored, the accommodating body in which the content material is accommodated, maintains a predetermined shape and is protected, and which, when the content material is consumed and the container is empty, is structured such that the outer packaging body of the outside or the component member is simply disassembled or transformed, and the volume is reduced and the occupied volume for the storage and transportation can be reduced. A powder accommodating container of the present invention to solve the above problems, which is structured by: a flexible bag having an opening, capable of storing the powder; a protecting member for enclosing at least part of the flexible bag, wherein the protecting member is capable of being transformed; and a cover mounted on the protecting member, for opening and closing the opening.

A powder accommodating container of the present invention to solve the above problems, which is structured by: a flexible bag having an opening, capable of storing the powder; a plurality of stays for enclosing at least part of the flexible bag; and a cover detachably mounted on the plurality of stays, for opening and closing the opening.

A powder accommodating container of the present invention to solve the above problems, which is structured by: a flexible bag body which accommodates the powder and can be reduced in size and deformed; a mouthpiece which is engaged with one opening of the flexible bag body and has a powder replenishing opening portion; a movable lid which is engaged with the mouthpiece and seals the powder replenishing opening portion so as to be opened and closed; a holding member engaged with the other opening of the flexible bag body; an outer packaging body by which the mouthpiece and the holding member are opposed and connected to each other, and the flexible bag body is accommodated, the powder accommodating container is characterized in that, when the powder in the flexible bag body is delivered and empty, the outer packaging body is separated from the mouthpiece and/or the holding member and is collapsed, and the flexible bag body is made reducible and deformable.

A powder accommodating container of the present invention, which is structured by: a flexible bag body which accommodates the powder and can be reduced in a size and deformed; a mouthpiece which is engaged with one opening of the flexible bag body and has a powder replenishing opening portion; a movable lid which is engaged with the mouthpiece and seals the powder replenishing opening portion so as to be opened and closed; a holding member engaged with the other opening of the flexible bag body; a detachable interval holding member by which the mouthpiece and the holding member are opposed to each other and the interval between these members is held, and the vicinity of both openings of the flexible bag body is held, the powder accommodating container is characterized in that, when the powder in the flexible bag body is delivered and empty, the interval holding member is separated from the mouthpiece and/or the holding member and is disengaged, and the flexible bag body is made reducible and deformable.

DETAILED DESCRIPTION OF THE PREFERRED EMBODIMENTS

Figure 1:
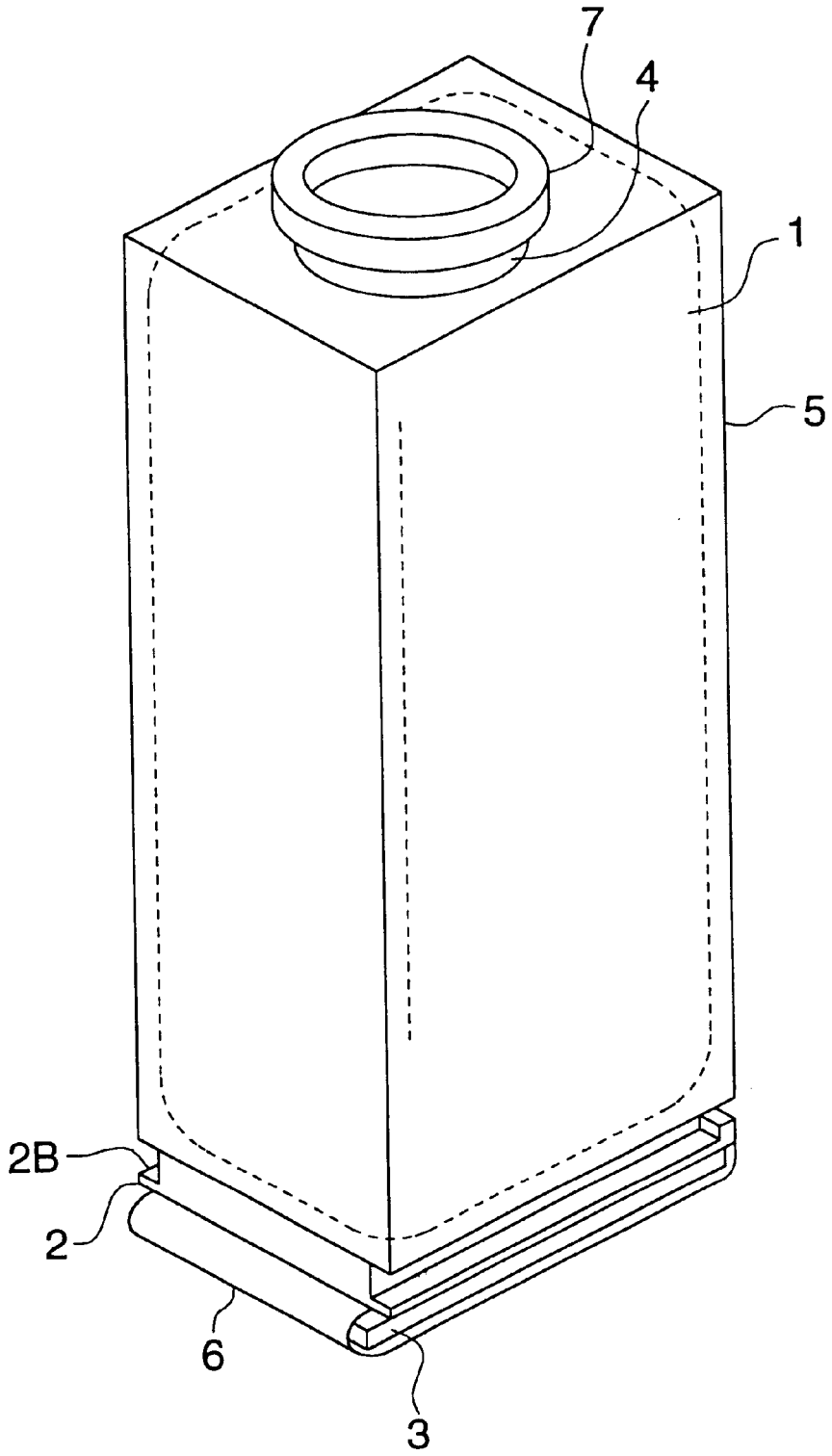
FIG. 1 is a perspective view showing an embodiment of a powder accommodating container according to the present invention.

Referring to the drawings, embodiments of a powder accommodating container of the present invention will be described below.

Figure 2:
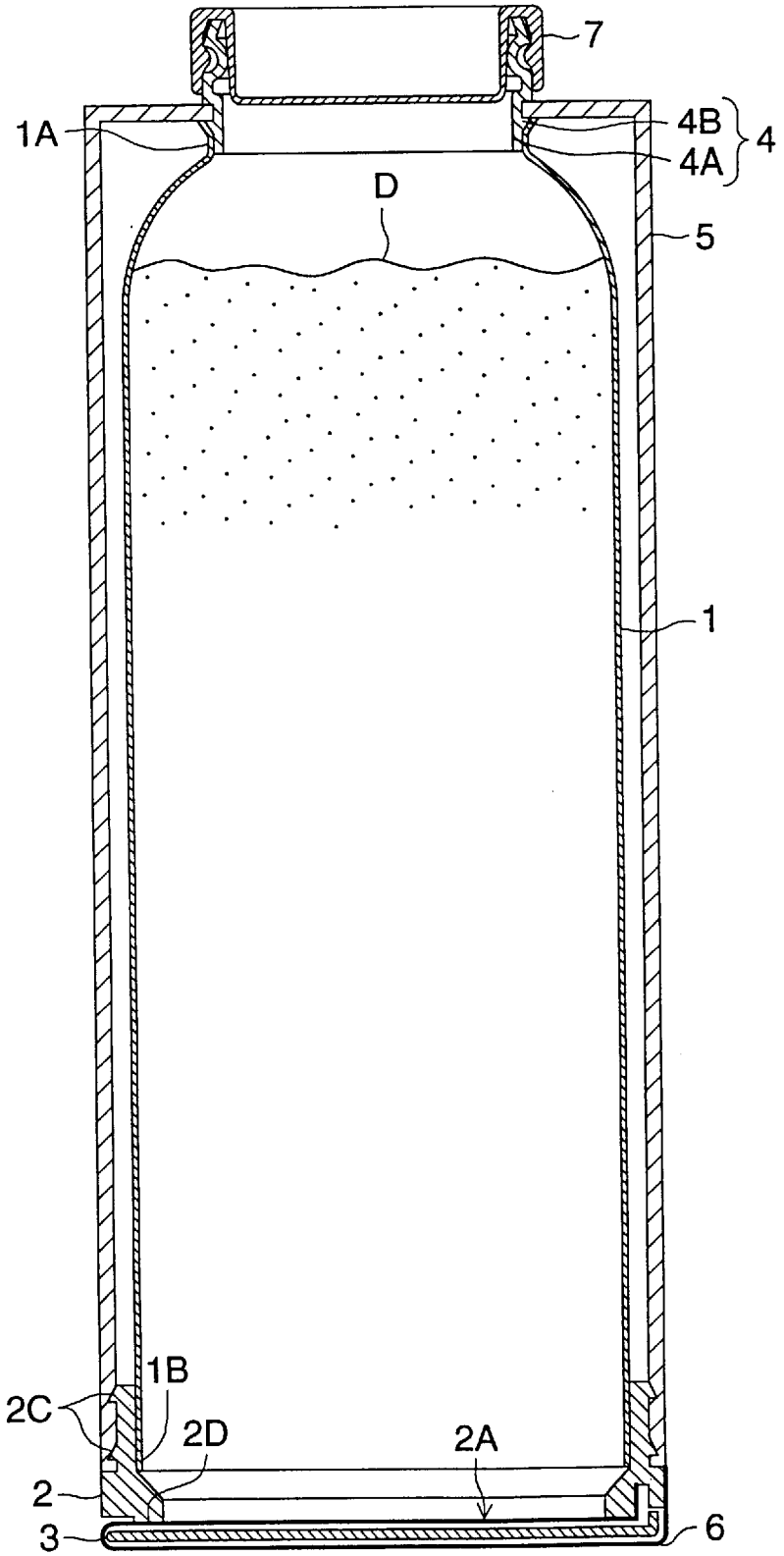
FIG. 2 is a sectional view of the powder accommodating container.

FIG. 1 is a perspective view showing an embodiment of the powder accommodating container according to the present invention, and FIG. 2 is a sectional view of the powder accommodating container.

As the powder accommodating container of the present invention, a developer accommodating container which is detachably mounted onto the developing device of an electrophotographic image forming apparatus, and replenishes the developer (toner or the like) to the developing device, will be described below as the embodiment.

Here, the developing device indicates the developing device itself, one that is integrated with a toner hopper for supplying developer to the developing device, or the toner hopper itself connected to the developing device by, for example, a toner conveyance pipe.

The developer accommodating container according to the present invention includes: a flexible bag body (accommodating body) 1 to accommodating the developer D; a mouthpiece 2 which is engaged with a bottom opening 1B of a flexible bag body 1 and has a developer supplying opening portion 2A; a movable lid 3 which is engaged with the mouthpiece 2 and seals the developer supplying opening portion 2A so as to be opened and closed; a holding member 4 (base member) which is engaged with a top opening 1A of the flexible bag body 1; and an outer packaging body 5 by which the mouthpiece 2 and the holding member 4 are opposed and connected to each other, and the flexible bag body 1 is housed.

The flexible bag body 1 is formed of single layer thin film such as polyethylene (PE), polypropylene (PP), or laminate film made of polyethylene (PE) and polyethylene terephthalate (PET), into the cylindrical shape. In consideration of disposing property, the single layer thin film is preferable, however, when the adhesion property is considered, the laminate film is more preferable. Further, when more adhesion property is necessary, it is preferable that ethylene vinyl acetate (EVA) layer is provided as a hot melt layer. Further, when the moisture proof property is considered, the film in which a nylon layer or an aluminum layer is.provided between a polyethylene (PE) layer and a polypropylene (PP) layer, is preferable. Further, from the relationship of physical properties of the toner , for example, in the case of the bag body including components of vinyl chloride group, because the toner is melt, it is not appropriate for the flexible bag body.

The powder supplying opening portion 2A is formed inside of the mouthpiece 2, and outside of the mouthpiece 2, an attachment portion 2B onto a developer replenishment device, which is not shown, and a first protruded portion 2C which is forcibly engaged with a holding portion of the inner wall of the outer packaging body 5, are formed. Incidentally, specifically in consideration of the assembling property and disassembling property, the present embodiment is structured such that the outer packaging body 5 is forcibly engaged with the first protruded portion 2C, however, the present invention is not limited to the structure of the present embodiment, but, for example, the structure in which the outer packaging body is adhered to the mouthpiece by an adhesive agent, or screwed onto that, may be allowable.

High density polyethylene resin (HDPE) is used for the mouthpiece 2, and it is formed by injection molding processing. In the case of high density polyethylene resins, because the strength is sufficient, it is appropriate for also the reuse, and appropriate for also the injection molding processing.

Here, high density polyethylene resin (HDPE) mentioned above indicates polyethylene resin having specific gravity of 0.94 to 0.96.

The outer surface of the periphery of the developer supplying opening portion 2A of the mouthpiece 2 is a sealing surface 2D, and is sealed by a flexible seal member 6.

At the time of the developer replenishment, the mouthpiece 2 is attached to the developer replenishing device which is not shown, and the flexible seal member 6 is pealed from the sealing surface 2D by the movement of a movable lid (slide cover) 3, which will be described later, the developer supplying opening portion 2A is opened, and the developer accommodated in the flexible bag body 1 is supplied into the hopper of the developer replenishing device. The flexible seal member 6 is the laminate film formed of polyethylene (PE) and polyethylene terephthalate (PET), and the surface of the polyethylene side is heat-sealed on the sealing surface 2D. Further, in the case of consideration of more adhesion property, it is preferable that ethylene vinyl acetate (EVA) layer is provided as a hot melt layer. Further, when the moisture proof property is considered, it is preferable that a nylon layer or an aluminum layer is provided between a polyethylene layer and a polyethylene terephthalate layer. Further, because the material of vinyl chloride group melts the toner, it is not appropriate for the flexible sealing member.

The top opening 1A of the flexible bag body 1 is connected to the holding member 4. An inner peripheral portion of the holding member 4 is formed into a hollow cylindrical developer replenishing opening 4A. In the developer manufacturing and filling process, the developer is filled from the developer supplying opening 4A into the flexible bag body 1.

A second protruded portion or a screw is formed on the upper portion of the outer peripheral surface of the holding member 4 and is engaged with a lid 7. After the developer is filled from the developer replenishing opening 4A into the flexible bag body 1, the opening 4A is closed and sealed by the lid 7. The lid is also formed of high density polyethylene resin (HDPE), or the like.

On the lower portion of the outer peripheral surface of the holding member 4, a second protruded portion 4B which is forcibly engaged with the opening (a second holder) of the upper portion of the outer packaging body 5, is formed. Accordingly, the upper portion of the outer packaging body 5 is connected to the holding member 4 having the second protruded portion 4B, and the lower portion of the outer packaging body 5 is connected to the mouthpiece 2 having the first protruded portion 2C, and the outer packaging body 5 is formed into box-like. The flexible bag body 1 is fixed and held between the holding member 4 of the upper portion of the outer packaging body 5 and the mouthpiece 2 of the lower portion of the outer packaging body 5. The outer packaging body 5 is formed of a card board, synthetic resins, or these laminated material.

Figure 3:
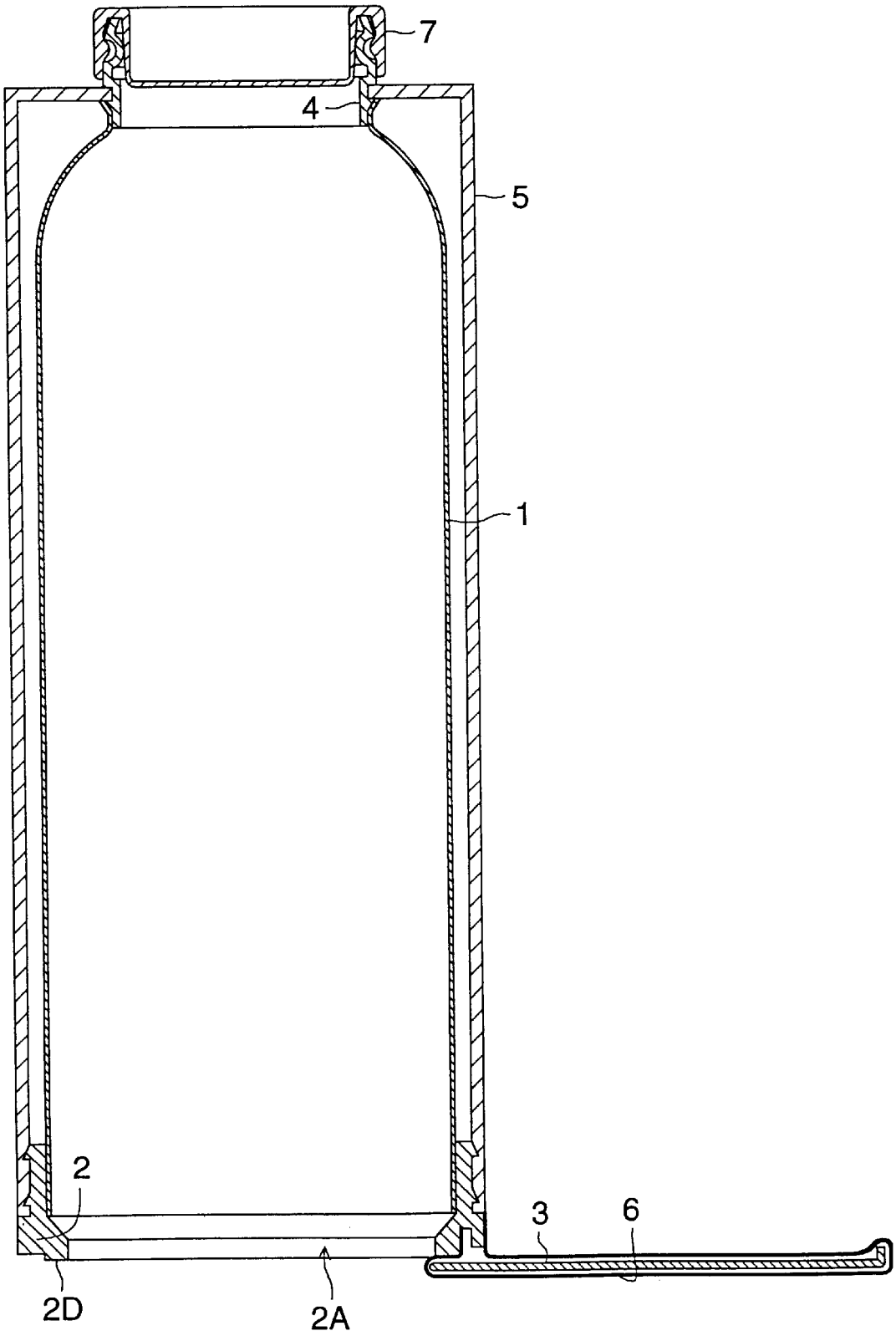
FIG. 3 is a sectional view showing a condition that a developer replenishing opening portion of the powder accommodating container is opened.

FIG. 3 is a sectional view showing a condition that the developer supplying opening 2A of the powder accommodating container (developer accommodating container) is opened.

One end portion of the longitudinal direction of the flexible seal member 6 is fixed on the end portion of the sealing surface 2D of the mouthpiece 2, and the other end portion of the flexible seal member 6 is fixed on the other surface of the mouthpiece 2. Both end portions of the flexible seal member 6 are fixed onto the mouthpiece 2 as described above, and the flexible seal member 6 is provided such that it is wound around the periphery of the slidable, movable lid 3 in the sliding direction. The movable lid 3 protects and shields the flexible seal member 6 which seals the developer supplying opening 2A, before the developer replenishment. The flexible seal member 6 which is adhered onto the sealing surface 2D so as to be peelable, seals the developer supplying opening portion 2A for the developer supply inside the sealing surface 2D. At the time of the developer replenishment, by the movement of the movable lid 3 which slides on the developer accommodating container, the flexible seal member 6 is gradually peeled from the one end portion of the sealing surface 2D, and the developer supplying opening portion 2A is opened.

The outer packaging body 5 connected to the holding member 4 and the mouthpiece 2, has the strength by which the damage and deformation do not occur, in each of normal conditions of the manufacture, storage, transportation, and use. When the developer D in the flexible bag body is delivered and empty, the outer packaging body 5 is forcibly separated from the mouthpiece 2 and the holding member 4, and can be disassembled.

Figure 4:
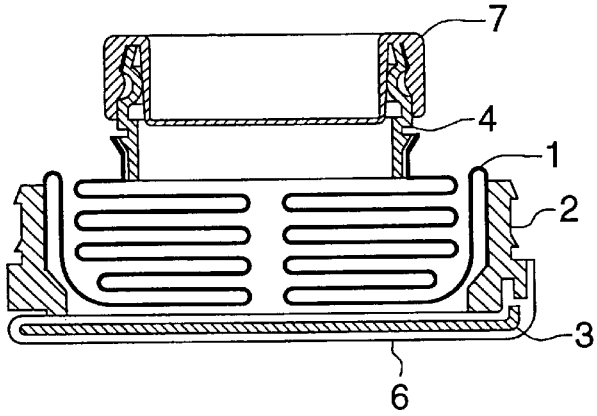
FIGS. 4(*a*) and 4(*b*) are a sectional view showing a condition that the powder accommodating container is reduced, except an outer packaging body which is disassembling-processed, and a perspective view showing a condition that the outer packaging body is collapsed.
Figure 4:
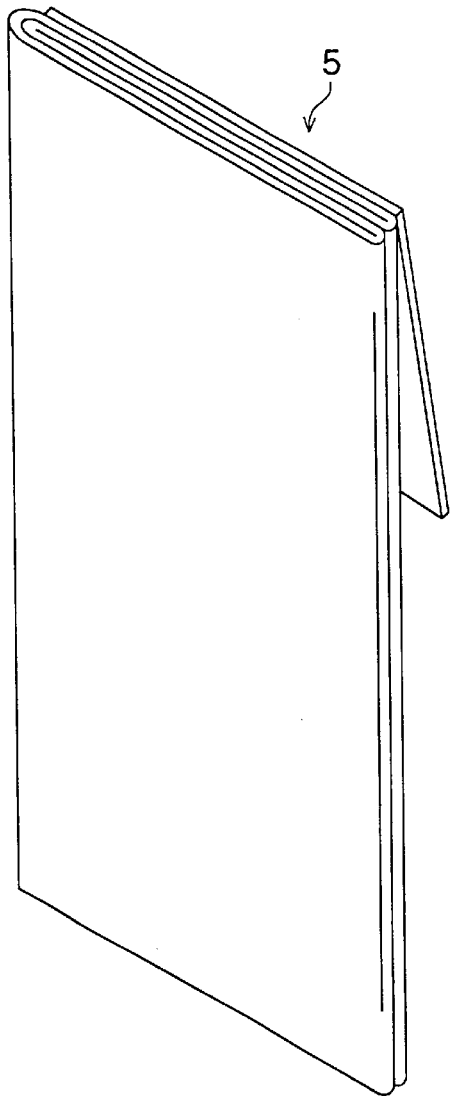

FIG. 4(*a*) is a sectional view showing a condition that the powder accommodating container (developer accommodating container), except the disassembling-processed outer packaging body 5, is reduced.

When the whole quantity of the developer D in the flexible bag body 1 is delivered, and the developer accommodating container is empty, the movable lid 3 is operated, and when being returned from the condition in FIG. 3 to the condition in FIG. 2, the flexible seal member 6 seals again the developer supplying opening portion 2A.

In this condition, the outer packing body 5 is forcibly separated for disassembling, from the first protruded portion 2C of the mouthpiece 2 and the second protruded portion 4B of the holding member 4. After disassembling, when the holding member 4 and the lid 7 are pushed into the mouthpiece 2 side, the flexible bag body 1 is compressed, and reduced and deformed, and the developer accommodating container except the outer packing body 5 is reduced. Incidentally, during the reducing operation of the developer accommodating container, because the upper and lower opening portions of the developer accommodating container are sealed by the lid 7 and the flexible seal member 6, even when the developer D remains in the flexible bag body 1, there is no possibility that the developer D leaks outside.

FIG. 4(*b*) is a perspective view showing the condition that the outer packaging body 5 is collapsed.

The volume of the outer packaging body 5 which is disassembling-processed, is reduced when being collapsed, and therefore, accumulation, storage, and transportation are easy. Further, processing of the resource recycling is also easy. Then, when the collected developer accommodating container is reused, each part is washed and inspected whether it is not damaged, and the damaged or deteriorated parts are replaced, and the developer accommodating container is assembled again for the use.

Incidentally, in the embodiment, the powder accommodating container constituted by the elements other than the outer packaging body 5 can be made compact in the state that the supplying cover constituted by the mouthpiece 2, movable lid 3 and the flexible seal member 6, and the replenishing cover constituted by the holding member 4 and the lid 7 are perfectly separated from the outer packaging body as the protecting member, and further the outer packaging body 5 can be made collapsible. The present invention, however, is not limited to this embodiment. For example, there can be formed the structure in which the protecting member is collapsed in the state that each one side of the supplying cover and the replenishing cover are mounted to the protecting member, and the powder accommodating container is transformed flat after use thereof. In the powder accommodating container such as structure stated above, since each opening of the flexible bag body is covered by the supplying cover or the replenishing cover, it cannot be caused that the developer remained slightly inside the flexible bag body splashes when the power accommodating container is crushed.

Furthermore, the flexible bag body in the present embodiment has the top opening 1A for replenishing the developing agent to the inside of the flexible bag body and the bottom opening 1B for supplying the developer to the developing device. However, the bottom opening may be also used serving as the function of the top opening 1A. In this case, it is required that after the developer is replenished to the flexible bag body, the flexible seal member is heat-sealed hermetically.

Figure 5:
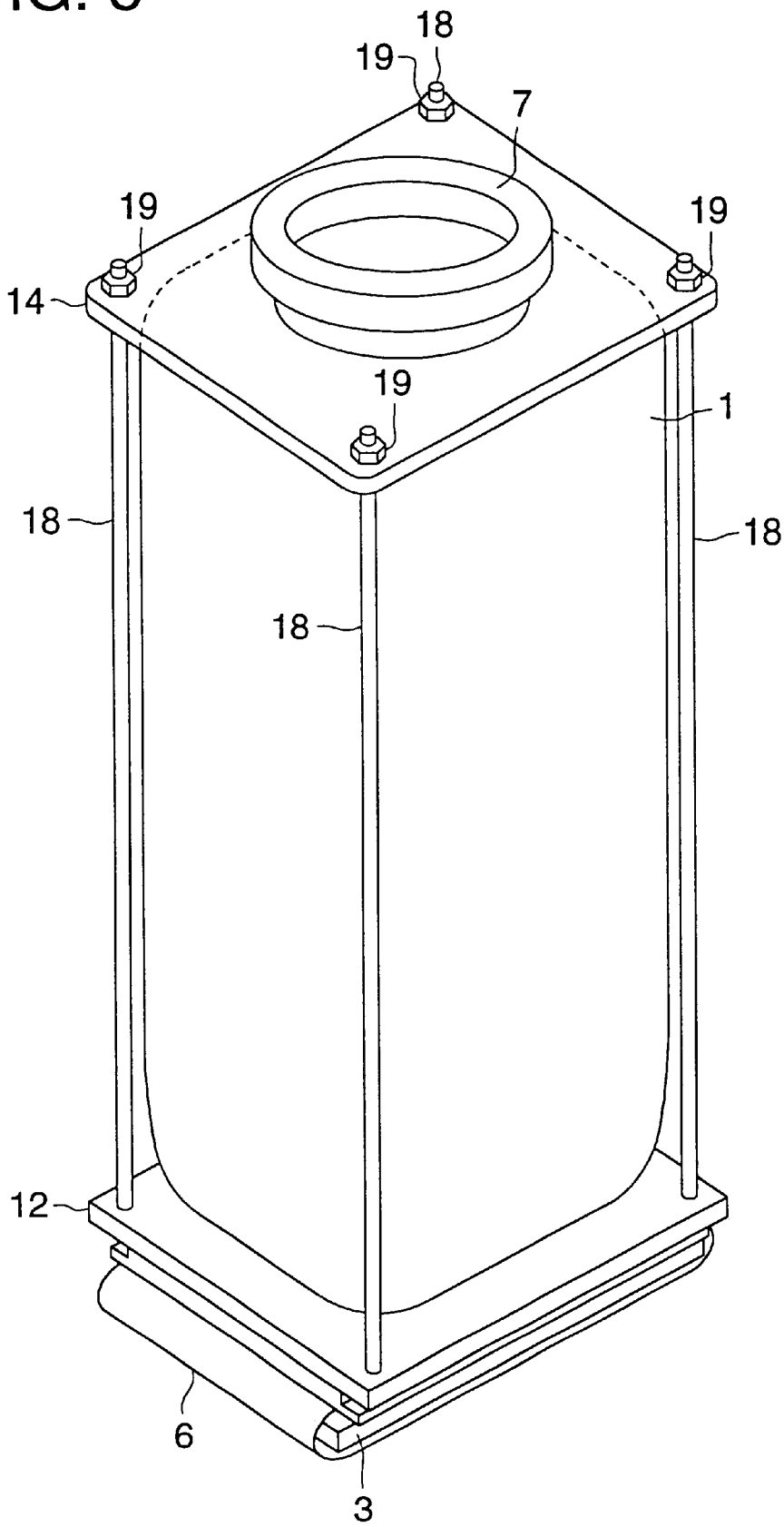
FIG. 5 is a perspective view showing another embodiment of the powder accommodating container of the present invention.
Figure 6:
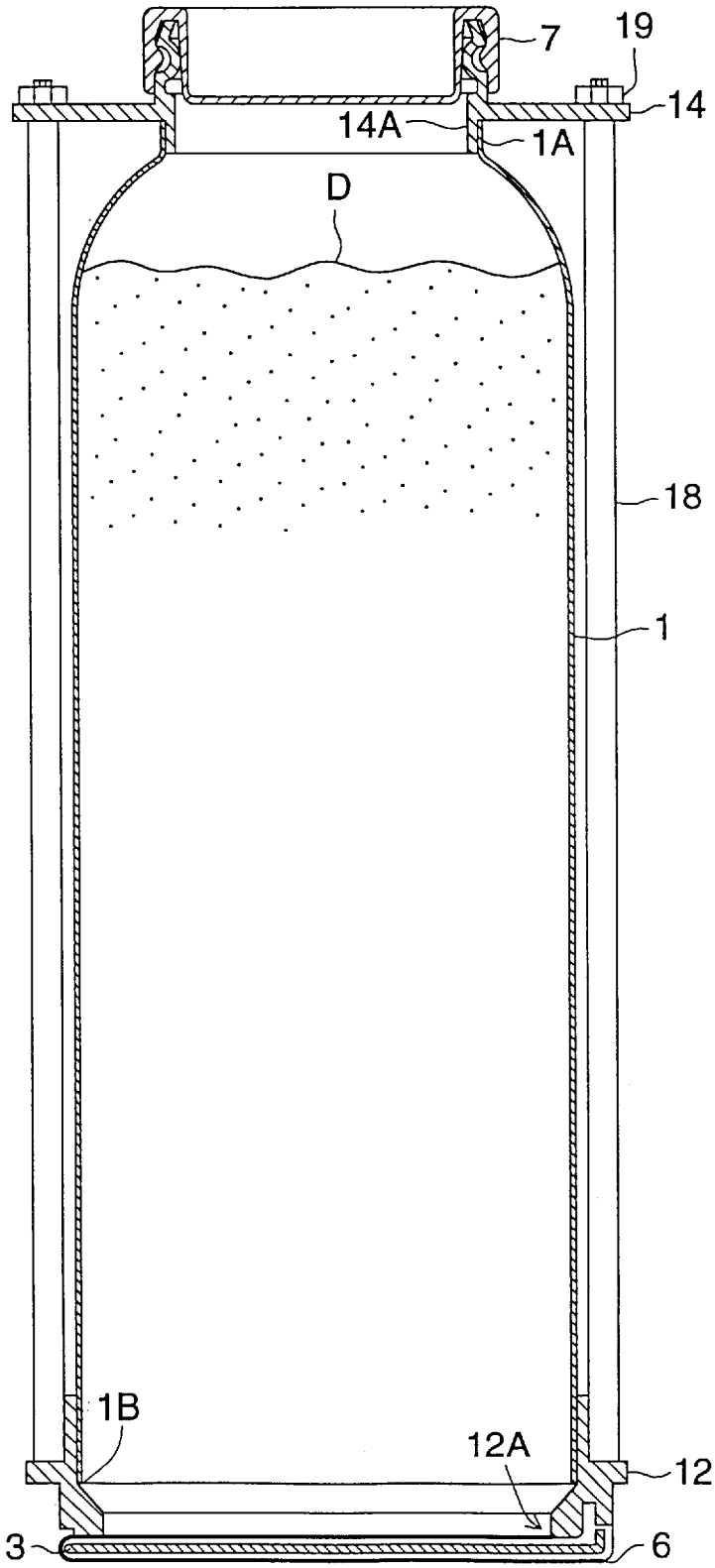
FIG. 6 is a central sectional view of the powder accommodating container shown in FIG. 5.
Figure 7:
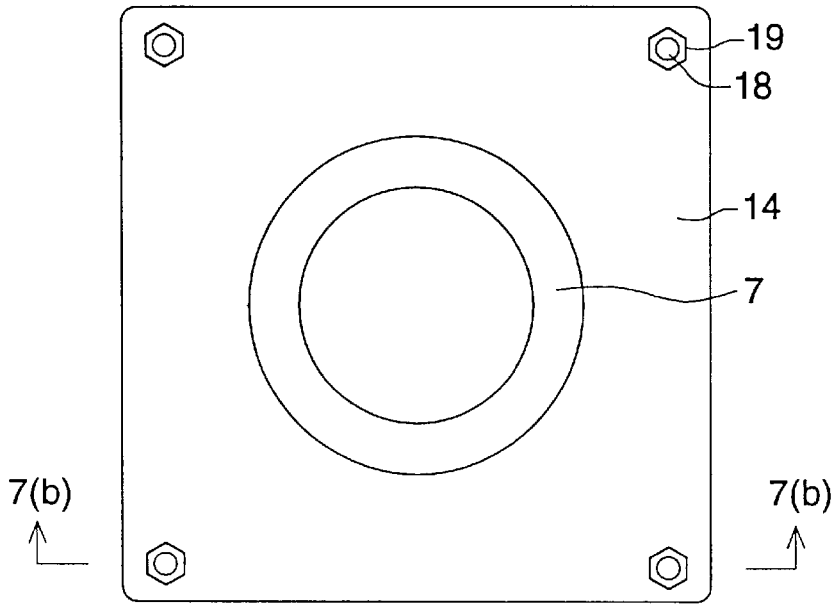
FIGS. 7(*a*) and 7(*b*) are a plan view of the powder accommodating container shown in FIG. 5, and a sectional view taken on line 7(*b*)–7(*b*).
Figure 7:
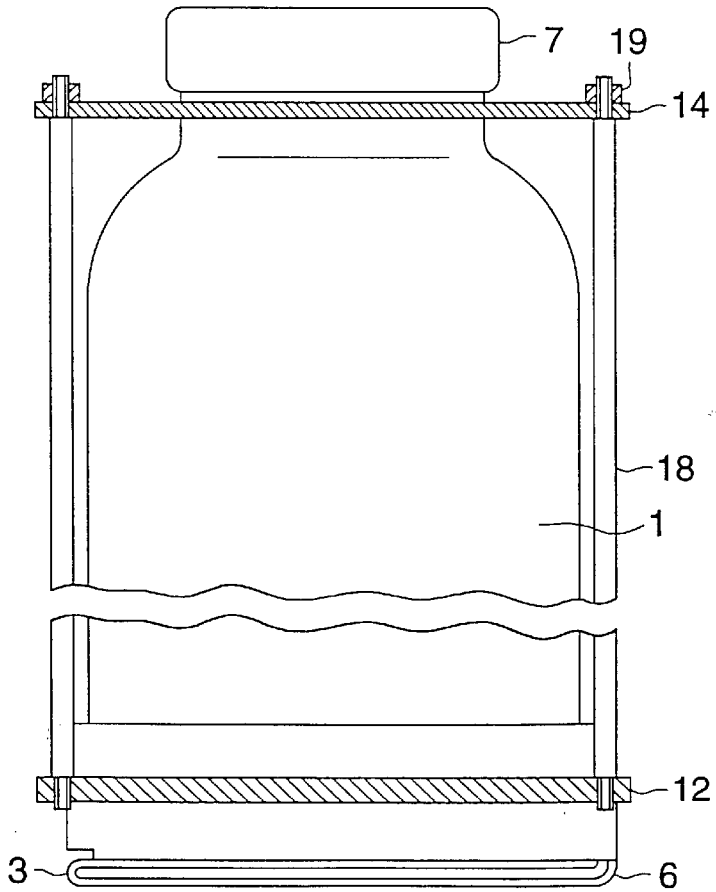

FIG. 5 is a perspective view showing another embodiment of the powder accommodating container (developer accommodating container) of the present invention, FIG. 6 is a its central sectional view, FIG. 7(*a*) is a its plan view, and FIG. 7(*b*) is a its sectional view taken on line 7(*b*)–7(*b*).

Incidentally, in numeral codes used in FIG. 5 through FIG. 7(*b*), parts having the same functions as in FIG. 1 through FIG. 4(*b*) are denoted by the same numeral codes. Further, the different points from the above described embodiment will be described below.

A powder accommodating container of the present invention is structured by: a flexible bag body 1 which accommodates the powder; a mouthpiece 12 which is engaged with a bottom opening portion 1B of the flexible bag body 1 and has a powder supplying opening portion 12A; a movable lid 3 which is engaged with the mouthpiece 12 and seals the developer supplying opening portion 12A so as to be opened and closed; a holding member 14 (base member) engaged with the top opening 1A of the flexible bag body 1; a lid 7 which seals a developer supplying opening portion 14A of the holding member 14; 4 interval holding members (stay bars) 18 by which the mouthpiece 12 and the holding member 14 are opposed and connected to each other, and the flexible bag body 1 is held; and nuts 19 which are screwed with the interval holding members 18.

Lower portions of 4 interval holding members 18 are screwed into the vicinity of 4 corners of the mouthpiece 12, and the interval holding member 18 is vertically studded on and fixed to the mouthpiece 12. The upper end portions and the lower end portions of 4 interval holding members 18 are formed into stepped screws. The stepped screw of the lower end portion is studded on the mouthpiece 12.

The stepped portion of the stepped screw of the upper end portion is brought into contact with the vicinity of the hole provided in the vicinity of 4 corners of the holding member 14, and positions the vertical direction of the holding member 14. The screw portions of the stepped screws pass through the holes provided in the vicinity of 4 corners of the holding member 14, and fasten and fix the holding member by nuts 19.

The holding member 14 to hold the upper portion of the flexible bag body 1, and the mouthpiece 12 to hold the lower portion of the flexible bag body 1 are held at a predetermined interval by 4 interval holding members 18, and the flexible bag body 1 accommodates the developer D, and is maintained in the predetermined shape.

The four interval holding members 18 maintain the flexible bag body 1 in which the developer is accommodated, in the predetermined shape, and maintain the strength by which the damage and deformation of the flexible bag body are not generated on each normal condition of the storage, transportation and use. The interval holding member 18 is formed of metal or plastic material.

Incidentally, the interval holding means for connecting the holding member 14 to the mouthpiece 12 is not limited to the interval holding member 18 and nuts 19, but the other well-known means may be applied for assembling and disassembling the powder accommodating container.

When the developer D in the flexible bag body 1 is delivered and empty, after nuts 19 are taken off from the screw portion of the upper portion of 4 interval holding member 18, the stepped screws of the lower portion of 4 interval holding member 18 are taken off from the mouthpiece 12 for disassembling.

After 4 interval holding member 18 are taken off and disassembled, when the holding member 14 and lid 7 are pushed into the mouthpiece 12 side, the flexible bag body 1 is compressed, and reduced and deformed, and the powder accommodating container is reduced, in almost the same manner as the condition shown in FIG. 4(*a*).

According to the powder accommodating container according to the present invention, while the unused powder accommodating container is in the transportation or storage, the flexible bag body in which the content material is accommodated, maintains the predetermined shape and is protected, and in the powder accommodating container in which the content material is consumed and empty, the outer packaging body of the outside is easily disassembled, the volume is reduced, and the occupation volume in the storage and transportation can be reduced.

Further, as the powder accommodating container is structured by a dual structure having the flexible bag body and the outer packaging body, it is not necessary to make the outer packaging body itself to be high sealed. Thus, it can be possible to make the powder accommodating container to be a simple structure in which the outer packaging body is relatively easily removed or collapsed. In addition, as the powder accommodating container is structured by a dual structure having the flexible bag body and the outer packaging body, and the powder is not adhered to the packaging body, the powder is not splashed when the outer packaging body is removed or the removed outer packaging body is transported for collection.

According to the powder accommodating container according to the present invention, the flexible bag body is held in the predetermined shape by the interval holding member, and the interval holding member is easily disassembled, and the volume of the container is reduced, and the occupation volume in the storage and transportation can be reduced.

What is claimed is:

1. A container for accommodating powder comprising a flexible bag having an opening and adapted to store said powder;

a protecting member enclosing at least part of said flexible bag wherein said protecting member can be transformed;

a cover on said protecting member for opening and closing said opening;

wherein said opening permits supplying said powder to another container;

wherein said flexible bag has a replenishing opening for replenishing said powder to said flexible bag; and wherein said container has a replenishing cover having a holding member and a lid for opening and closing said replenishing opening.

2. The powder accommodating container of claim 1 wherein the replenishing cover is mounted on the protecting member.

3. The powder accommodating container of claim 2 wherein the cover and the replenishing cover are detachably mounted on the protecting member.

4. The powder accommodating container of claim 2 wherein the replenishing cover comprises a lid member and a base member for the lid member.

5. The powder accommodating container of claim 1 wherein one of the replenishing cover and the protecting member has a second protrusion member and the other has a second holder for holding the second protrusion member.

6. The powder accommodating container of claim 4 wherein the lid member and the base member are made from high density polyethylene resin.

7. The container of claim 1 wherein said flexible bag is a film having a single layer.

8. The container of claim 1 wherein said flexible bag is a laminated film having an adhesive layer.

9. The containing of claim 1 wherein said flexible bag is a laminated film having a moisture proof layer.

10. A container for accommodating powder comprising a flexible bag having an opening and adapted to store said powder;

a protecting member enclosing at least part of said flexible bag wherein said protecting member can be transformed;

a cover on said protecting member for opening and closing said opening;

a mouthpiece, having an opening portion, on said flexible bag; and a movable lid member on said mouthpiece for opening and closing said opening portion.

11. The powder accommodating container of claim 10 wherein the cover further comprises a flexible seal member adhered to the mouthpiece for closing the opening portion of the mouthpiece, and the flexible seal member is peeled in accordance with a movement by which the movable lid member is opened, thereby the opening portion of the mouthpiece is opened.

12. The powder accommodating container of claim 10 wherein one of the cover and the protecting member has a first protrusion member and the other has a holder for holding the first protrusion member.

13. The powder accommodating container of claim 10 wherein the mouthpiece and the movable lid member are made of high density polyethylene resin.

14. The powder accommodating container of claim 10 wherein the flexible bag comprises a film of a single layer.

15. The powder accommodating container of claim 10 wherein the flexible bag comprises a laminate film having an adhesive layer.

16. The powder accommodating container of claim 10 wherein the flexible bag comprises a laminate film having a damp proof layer.

17. The powder accommodating container of claim 12 further comprising a member for attaching to a developing device provided on an image forming apparatus.

18. A container for accommodating powder comprising a flexible bag having an opening and adapted to store said powder;

a protecting member enclosing at least part of said flexible bag wherein said protecting member can be transformed; and a detachable cover on said protecting member for opening and closing said protecting member;

wherein said flexible bag is on said cover and is adapted to be folded in a state wherein said cover is detachable from said protecting member and said flexible bag is substantially empty.

* * * * *